US005347656A

United States Patent [19]

Fabritz et al.

[11] Patent Number: 5,347,656

[45] Date of Patent: Sep. 20, 1994

[54] FIGURE-ENHANCING PNEUMATIC BATHING SUIT

[75] Inventors: Jacqueline M. B. Fabritz, Surfside; Marshall L. Barth, Los Angeles; Anthony R. Longo, Huntington Beach, all of Calif.

[73] Assignee: CCC Acquisitions Corp., Los Angeles, Calif.

[21] Appl. No.: 911,755

[22] Filed: Jul. 10, 1992

[51] Int. Cl.[5] ..... A41D 5/00

[52] U.S. Cl. ..... 2/67; 2/DIG. 3; 450/38

[58] Field of Search ..... 2/67, DIG. 3, 267; 450/55, 56, 57, 38, 30, 88; 137/846, 845; 36/29

[56] References Cited

U.S. PATENT DOCUMENTS

| | | | |
|---|---|---|---|
| 146,805 | 1/1874 | Cox | 450/38 |
| 1,570,636 | 1/1926 | Meilland . | |
| 1,580,439 | 4/1926 | Meilland . | |
| 2,292,150 | 8/1942 | Murray . | |
| 2,516,129 | 7/1950 | Leo et al. . | |
| 2,544,300 | 3/1951 | Davenport et al. | 450/38 |
| 2,597,924 | 5/1952 | Davenport et al. . | |
| 2,697,229 | 12/1954 | Krueger . | |
| 2,741,769 | 4/1956 | White | 450/38 |
| 2,764,759 | 10/1956 | Gazelle | 450/38 |
| 2,803,823 | 8/1957 | Broadwin . | |
| 2,826,202 | 3/1958 | Star | 450/38 |
| 2,864,372 | 12/1958 | Buckley | 450/57 X |
| 2,883,987 | 4/1959 | White | 450/38 |
| 2,897,821 | 8/1959 | Lerner . | |
| 3,020,914 | 2/1962 | Garson . | |
| 3,068,494 | 12/1962 | Pinkwater . | |
| 3,133,696 | 5/1964 | Mirando . | |
| 3,255,754 | 6/1966 | Brumberger | 450/55 |
| 3,326,218 | 6/1967 | McAlpine | 450/38 |
| 3,421,514 | 1/1969 | Friedlander . | |

FOREIGN PATENT DOCUMENTS

| | | | |
|---|---|---|---|
| 135715 | 3/1948 | Australia | 450/38 |
| 00753 | 2/1990 | PCT Int'l Appl. . | |
| 00754 | 2/1990 | PCT Int'l Appl. . | |
| 324870 | 2/1930 | United Kingdom | 450/38 |

OTHER PUBLICATIONS

"Air Bikini Top Pumps Up the Bust" by Elizabeth Snead, *USA Today*, Jul. 28, 1992.

(List continued on next page.)

*Primary Examiner*—Clifford D. Crowder
*Assistant Examiner*—Larry D. Worrell, Jr.
*Attorney, Agent, or Firm*—Amster, Rothstein & Ebenstein

[57] ABSTRACT

A bathing suit top includes inflatable bladders in each of the cup portions of the top to provide support for the breasts of the wearer. An air pump is secured to the inflatable portions of the bathing suit top to selectively fill the first and second breast support bladders with ambient air. The air pump is preferably positioned in the connecting portion of the bathing suit top between the two cups such that the pump can be discretely hidden behind a small piece of fabric. When the air pump is depressed air is forced into the two air bladders in the bathing suit cups and the breast support bladders are simultaneously filled to the same level in order to provide the identical amount of support to both breasts. The breast support bladders are designed to include three peninsula shaped sections to enable the breast support bladder to conform to the shape of the individual wearers breasts. When air is forced into the breast support bladders the three sections of the bladder will fan outward to conform to the front and side portions of the breast to provide support to all of the portions of the breast. After the support air bladders have been inflated to their desired size a stopper is placed over the air intake valve to hold the desired amount of air in the bladders.

3 Claims, 5 Drawing Sheets

U.S. PATENT DOCUMENTS 3,651,522 3/1972 Bernfeld .
3,663,968 5/1972 Mohl et al. .
3,852,833 12/1974 Koneke et al. .
4,024,856 5/1977 Kirianoff .
4,178,013 12/1979 Bataille .
4,178,643 12/1979 Cox, Jr. .
4,232,459 11/1980 Vaccari .
4,236,725 12/1980 Bataille .
4,370,754 2/1983 Donzis .
4,372,320 2/1983 Silber .
4,414,691 11/1983 Estruch ..... 2/67
4,674,479 6/1987 Jennings et al. .
4,702,022 10/1987 Porcher .
4,712,316 12/1987 Baggie .
4,730,403 3/1988 Walkhoff .
4,823,482 4/1989 Lakic .
4,991,230 2/1991 Bacanti .
5,005,300 4/1991 Diaz et al. .
5,037,341 8/1991 Howard .
5,074,765 12/1991 Pekar ..... 36/29 X
5,086,514 2/1992 Ross .
5,091,992 3/1992 Pusic .
5,113,599 5/1992 Cohen et al. ..... 36/88

FIGURE-ENHANCING PNEUMATIC BATHING SUIT

FIELD OF THE INVENTION

The present invention is related to bathing suits and, in particular, to figure-enhancing bathing suit tops for women.

BACKGROUND OF THE INVENTION

Over the years, numerous efforts have been made to develop bathing suits which would enhance the figure of the wearer. In particular, numerous attempts have been made to develop a bathing suit top which would give the wearer the appearance of having larger breasts. Generally speaking, these suits have fallen into two categories: suits that attempt to create an optical illusion of larger breasts, and suits that utilize pads to supplement the bust-line.

Thus far, neither of these two approaches has proven wholly satisfactory. Specifically, there are limits on the ability of the optical appearance of the suit to make the bust appear larger. Further, only certain suit designs will produce the desired optical effect. Thus, the use of the optical appearance of the suit to enhance the appearance of the breasts, significantly restricts the variety of bathing suit styles available to the wearer.

While pads are much more effective in enlarging the appearance of the bustline, they can be bulky and difficult to conceal. As a result, pads are primarily used in one-piece bathing suits which provide greater coverage. Existing pads are likewise undesirable in that they typically come in a size which is standard for the suit, providing too much enhancement for the taste of some wearers and not enough enhancement for the taste of others.

Therefore, there exists a need for an improved figure-enhancing swimsuit which can significantly enhance the appearance of the bust-line, be used in a relatively wide variety of swimsuit designs, yet be easily concealed and customized to meet the requirements of the individual user.

SUMMARY OF THE INVENTION

The present invention is a bathing suit, including a top having first and second cup portions, wherein each cup portion includes inflatable bladders to provide support for the breasts of the wearer. In addition, the top includes a pump member secured to the top to selectively fill the inflatable bladders with air. Advantageously, the cup portions are each covered with a layer of fabric which is stretchable in response to the filling of the bladders with air.

The bathing suit of the present invention includes atop having first cup portion for receiving a breast of the wearer which includes a first breast support air bladder, a second cup portion for receiving another breast of the wearer which includes a second breast support air bladder, a connecting portion which connects the first and second cup portions which is sized and shaped to be positioned between the breasts of the wearer, a support portion which is attached to the first and second cup portions partially encircling the wearer and securing the first and second cup portions to the body and an air pump secured to one of the portions of the bathing suit top to selectively fill the first and second breast support bladders with ambient air.

The air pump is preferably positioned in the connecting portion of the bathing suit such that the pump can be discretely hidden between the breasts of the wearer. The air pump is directly affixed to at least one of the bladders but is desirably affixed to both of the bladders. Preferably, the first and second breast support bladders are in fluid communication such that when air is introduced from the pump, it is evenly distributed into each of the two breast support bladders to provide the same amount of support to each breast.

The breast support bladders are designed to include a plurality of peninsula-shaped sections which are formed adjacent a top portion of the bladder. In the preferred embodiment, each of the breast support bladders is divided into three such peninsula-shaped sections to enable the breast support bladders to conform to the shape of the individual wearer's breasts. As the air bladder is inflated, the center of the three sections will be pressed forward while the two side sections will fan outward to conform to the sides of the breast and provide additional support to the side sections of the individual cup portions. Importantly, this allows a single bladder size to be used with many bathing suit sizes, thus reducing manufacturing costs. Further, the three segment design prevents an unnatural bulge from forming in the front portion of the cup. Finally, if the wearer does not wish to fully inflate the breast support bladders, because the breast support bladders are in fluid communication, the same partial degree of inflation will automatically be provided to both cup portion of the top.

In another embodiment of the present invention, a bathing suit including a top, comprises a first cup portion for receiving a breast, such that the first cup portion includes a first breast support air bladder, a second cup portion for receiving a breast, such that the second cup portion includes a second breast support air bladder, a connecting portion connecting the first and second cup portions sized and shaped to be positioned between the breasts of a wearer and defining a central air channel communicating with the first and second breast support bladders. An air pump is secured to the connecting portion for selectively filling the first and second breast support bladders with air. The pump includes a first section having an inlet valve for drawing in ambient air and a second section having an outlet valve for directing air from the first section into the central air channel.

DETAILED DESCRIPTION OF THE INVENTION

Figure 1:
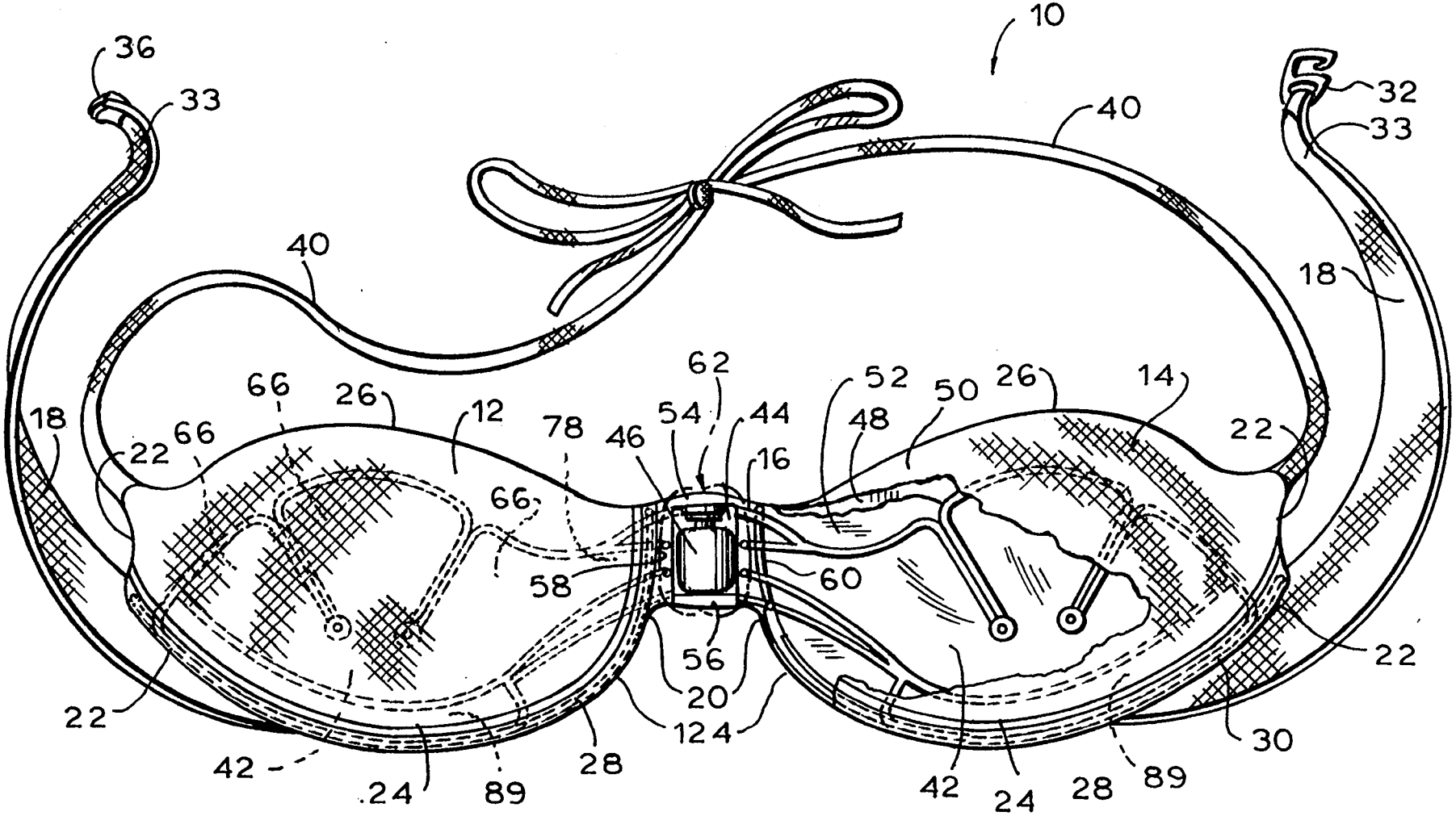
FIG. 1 is a rear plan view of a preferred embodiment of the swimsuit of the present invention in a non-inflated state.

As illustrated in FIG. 1, the preferred embodiment of the present invention is a bikini style bathing top 10 designed to appear the same as a conventional bikini top. The bathing top 10 includes a first cup portion 12, a second cup portion 14, a connecting portion 16 positioned between the cup portions 12,14, a first two-piece support portion 18 or band which partially encircles the wearer and secures the cup portions 12,14 to the wearer. Each of the cup portions 12,14 includes an inner edge 20, an outer edge 22, a bottom edge 24 and a top edge 26. Each of the cup portions 12,14 includes an arcuate underwire support 28 along its bottom edge 24. Each piece of the first support portion 18 or band is attached to the outer edge 22 of each of the cup portions 12,14 along one edge 30 of the band pieces. The two pieces of the band stretch around the back of the wearer where the two pieces are attached together by a hook member 32 on the other edge 33 of one band which inserts into a fabric loop 36 on the other edge 33 of the other band. Further, the top edge 26 of each cup is attached to a second two-piece support 40 or shoulder strap which extends past the shoulders of the wearer and ties behind the neck of the wearer. The first and second support portions 18,40 may be replaced by any other type of supporting means, such that the cup portions 12,14 of the bathing suit top 10 are held against the wearer. Likewise, either the first or second support portions 18,40 could be eliminated, leaving the support function to the remaining support portion.

At this point, the above description of the bathing top 10 of the present invention can be applied to any conventional bathing top. However, the bathing top 10 of the present invention includes a breast support air bladder 42 inserted within each of the cup portions 12,14 of the bathing top 10 to provide support for the breasts of the wearer. Further, the preferred embodiment of the bathing suit top 10 of the present invention includes an integrated inflatable air bladder assembly 44 which comprises two inflatable breast support air bladders 42 which are in fluid communication with each other and an air pump 46 to force air into the breast support bladders 42. The breast support air bladders 42 are placed in the cup portions 12,14 of the bathing suit top 10 and the pump 46 is positioned on the connecting portion 16 between the two cup portions 12,14.

The cup portions 12,14 of the bathing suit top 10 are formed of a first inner fabric layer 48, a second inner fabric layer 50 and an outer fabric layer 52. The first and second inner fabric layers 48,50 and the outer fabric layer 52 are sewn together along substantially all of the edges of the cup portions 12,14. The outer fabric layer 52 is of a decorative nature and gives the bathing suit an attractive appearance when it is worn. The outer fabric layer 52 is not only attractive, but is durable to sustain repeated wearings and washings of the bathing suit. Further, the outer fabric layer 52 is stretchable to enable expansion of the bathing suit top 10 when the breast support air bladders 42 are filled with air. Preferably, the outer fabric layer 52 is made of a Lycra®, Spandex®, cotton or polyester blend material. The first and second inner fabric layers 48,50 are made of a thick soft material, such as a tricot covered foam, and are provided to cushion and protect the breast support air bladders 42. The breast support air bladder 42 is positioned between the first and second inner fabric layers 48,50 of the cup portions 12,14 of the bathing suit top 10. The first inner fabric layer 48 is provided to protect the breast support bladder 42 from the outer fabric layer 52 and any exterior elements. The second inner fabric layer 50 is provided to keep the breast support bladder 42 from contacting the skin of the wearer.

The connecting portion 16 of the bathing suit top 10 which connects the two cup portions 12,14 is made of a trapezoidal piece of material, preferably of the same design as the material of the outer fabric layer 52. The connecting portion 16 comprises a top edge 54, a bottom edge 56, a first connecting edge 58 and second connecting edge 60 which each mate with a corresponding inner edge 20 of one of the cup portions 12,14. The top edge 54 of the connecting portion 16 is designed to form a continuous edge with the top edges 26 of each of the two cup portions 12,14 as the cup portions 12,14 meet the connecting portion 16. The first and second connecting edges 58,60 of the connecting portion 16 are sewn together with their respective mating inner edges 20 of the cup portions 12,14 to integrate the bathing suit top 10 into one unit. A fabric covering 62 or ring, preferably made from the same type of decorative material as the outer fabric layer 52 of the cup portion, is looped around the connecting portion 16 of the bathing suit top 10 and is designed to cover the pump 46 so it is not visible during wear.

Figure 3:
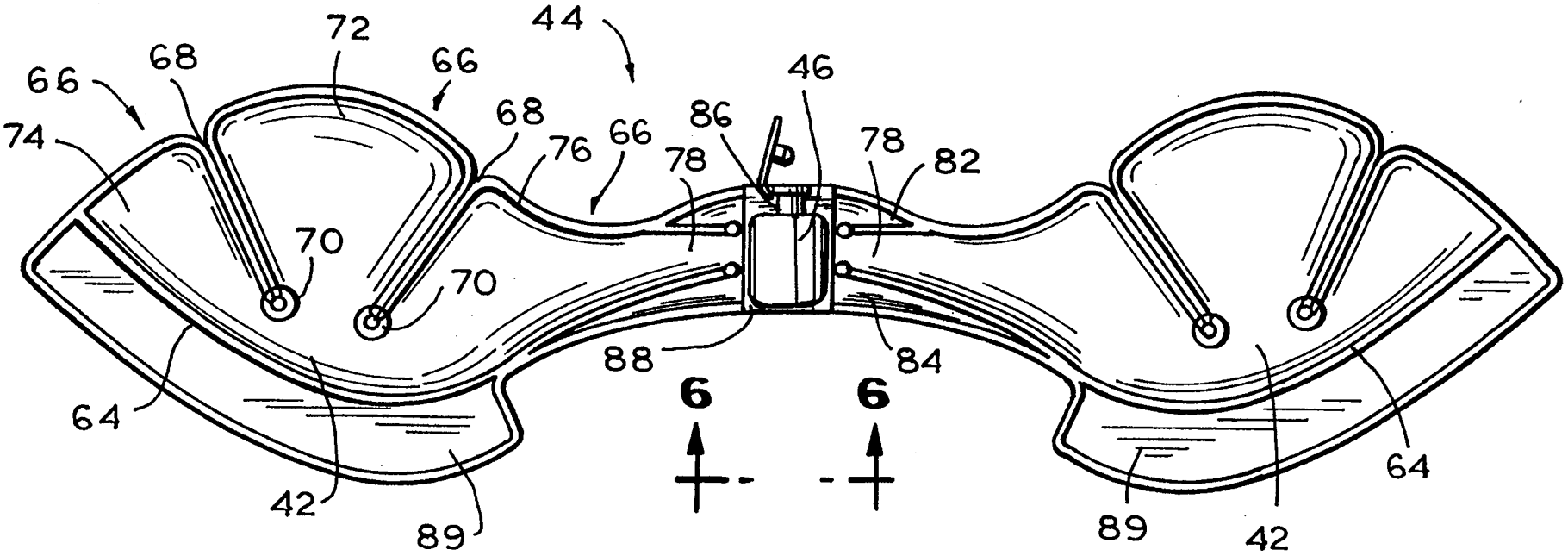
FIG. 3 is a top plan view of the inflatable bladders and pump of the swimsuit of FIG. 1.

The preferred embodiment of the integrated inflatable assembly 44 of the present invention is illustrated in FIG. 3. The breast support air bladders 42 of the integrated inflatable assembly 44 are identically shaped and sized and are in fluid communication with each other. Each breast support air bladder 42 is generally scallop-shaped, with a relatively wide lower edge 64. The individual breast support air bladders 42 of the preferred embodiment are divided into peninsula shaped segments 66 by substantially elongated V-shaped slits 68 which terminate at eyelet shaped openings 70. The peninsula shaped sections are proximate each other when the air support bladders 42 are not inflated, but fan outward as the segments 66 are inflated. Preferably, each breast support air bladder 42 forms two V-shaped slits 68 and eyelets 70. The breast support air bladder 42 is then sealed closed along all of the edges of the eyelets 70 and slits 68 to form three separate peninsula shaped segments 66, a central segment 72, a first side segment 74 and a second side segment 76, per breast support bladder 42. The eyelets 70 are made at the termination of the V-shaped slits 68 to give the peninsula shaped segments 66 a greater freedom of movement in order to allow the central segment 72, and first and second side segments 74,76 to fan outward as the individual segments 66 are inflated. The V-shaped slits 68 which separate the peninsula shaped sections have a length of at least 1.5 inches. Further, the peninsula shaped sections have a thickness when fully-inflated of at most 1.3 inches. The preferred three segment configuration is designed to enable the breast support air bladder 42 to better conform to the shape of the wearer's breast which will described in more detail below.

The preferred integrated inflatable assembly 44 also includes a central air channel 78 connecting the individual breast support bladders 42 together and an outlet valve 80 (FIG. 5) to the central air channel 78 to allow air to flow from the pump 46 into the breast support air bladders 42. The central air channel 78 is desirably no wider than 0.8 inches, and preferably no wider than 0.3 inches, for reasons which will be discussed below. The central air channel 78 is bordered by an upper connecting flange 82 and lower connecting flange 84 which are designed to secure an upper end 86 and lower end 88 of the pump 46 against twisting forces, thereby preventing the pump 46 from being pulled apart from the central air channel 78. The overall width of the central air channel 78, the upper connecting flange 82 and the lower connecting flange 84 is considerably narrower than the breast support bladders 42 because all three elements must be hidden behind the connecting portion 16 of the bathing suit top 10 which is considerably narrower than the cup portion 12,14 of the top 10. The capacity of the central air channel 78 is identical on both sides of the pump 46 as the central air channel 78 extends into the individual breast support bladders 42, thus equal portions of air will be delivered to each of the cup portions 12,14. The central air channel 78 allows constant communication between the two breast support bladders 42 to enable the inlet air from the pump 46 to equalize between the two chambers. Thus, both portions of the bathing suit top 10 will always be inflated to the same level. The integrated inflatable assembly 44 with the integrated pump 46 is advantageous over the padded bathing suit designs of the prior art, as a conventional swimsuit top may be designed without taking into consideration the specific configuration of the breast support air bladders 42.

Also illustrated in FIG. 3 is an attachment flange 89 which extends from the breast support air bladders 42 in the preferred embodiment of the integrated inflatable assembly 44 of the present invention. The attachment flange 89 is approximately ½ inch wide and is sealed off from breast support air bladders 42 such that air can not pass into the attachment flange 89 from the breast support air bladders 42. The attachment flange 89 is provided to enable the integrated inflatable assembly 44 to be sewn along the entire bottom edge 24 of each of the cup portions 12,14 of the bathing suit top 10 to prevent movement of the inflatable assembly 44 within the bathing suit top 10 during wear. The attachment flange 89 is sealed off from the breast support air bladder 42 to enable the integrated inflatable assembly 44 to be sewn into the bathing suit top 10 without introducing holes into the breast support bladder 42. The flange is designed to be at least ½ inch wide to provide for a substantial margin for error during the assembly process. The assembly margin is crucial as any holes which are introduced during assembly will allow air to leak out of the breast support bladder 42 and render the inflatable assembly 44 of the swimsuit useless.

Figures 4, 5:
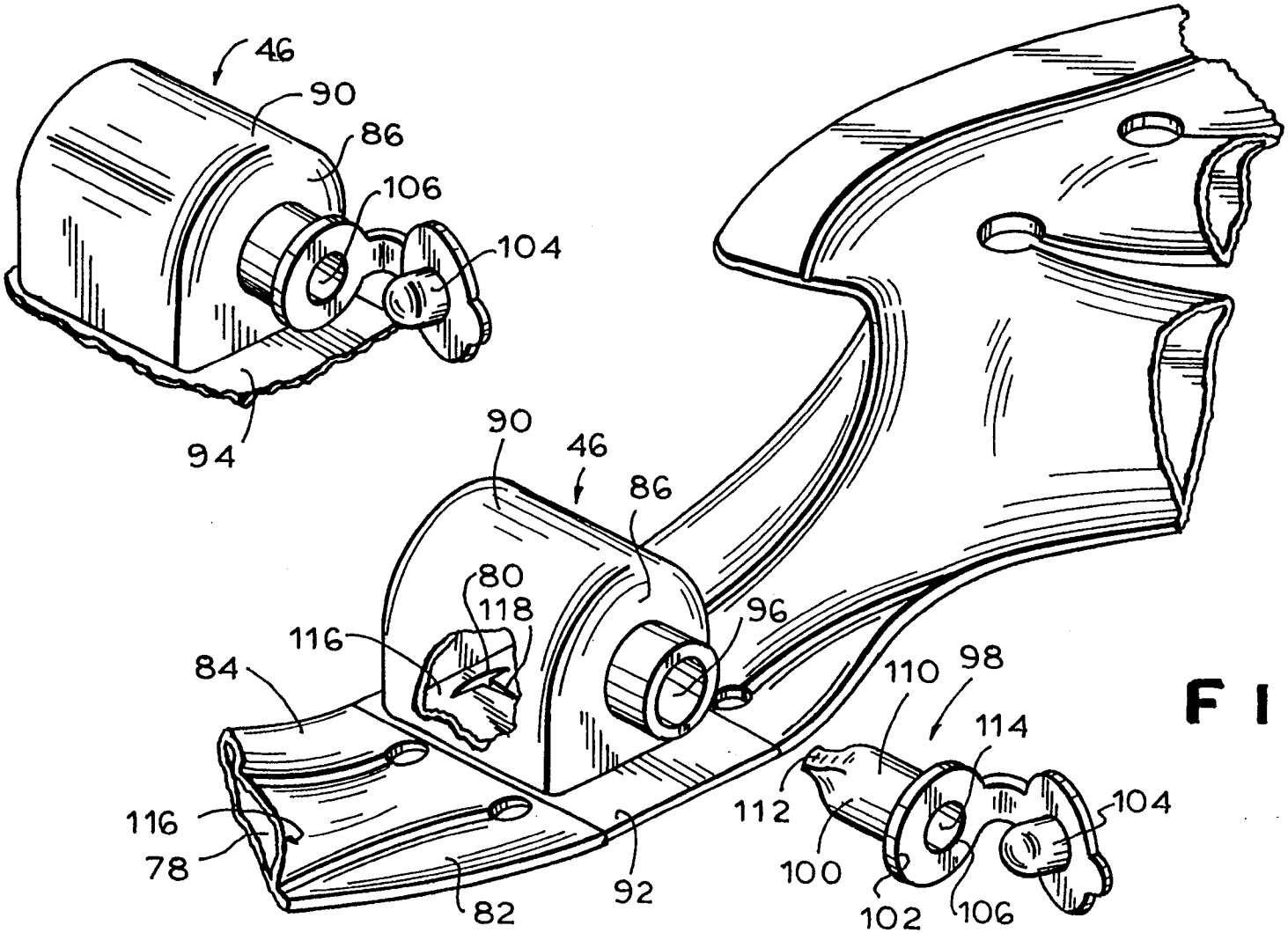
FIG. 4 is a perspective view of the pump of the swimsuit of FIG. 1.
FIG. 5 is a partially cut-away exploded perspective view of the pump and valve mechanism of the swimsuit of FIG. 1.

FIGS. 4 and 5 illustrate in more detail the pump 46 of the present invention. The pump 46 has a first section 90, preferably made of an elastomeric material, such as vinyl, which can be easily depressed and will return to its original shape, and a second or planar section 92 formed by the area of the central air channel 78 and connecting flanges 82, 84 covered by the first section 90 of the pump 46. The first section 90 of the pump 46 is shaped like a U-shaped barrel having a pair of open ends. The open ends of the U-shaped section of the first section 90 of the pump 46 are positioned against and are closed by the second planar section 92 of the pump 46. The edges of the open end of the first section 90 terminate into a thin mounting extension 94 which surrounds the bottom periphery of the first section 90 to provide a surface to enable the first section 90 to be heat sealed to the second section 92.

The pump 46 has a circular intake opening 96 at the upper end 86 of the barrel shaped pump 46 to enable air to flow into the pump 46. A small first inlet valve or duck bill valve assembly 98 is placed within the intake opening 96 of the pump 46 to regulate the air flow into and out of the pump 46. The duck bill valve assembly 98 comprises a typical duck bill valve 100, a circular positioning flange 102 and a small stopper assembly 104. The small stopper assembly 104 is attached to the circular flange at the top of the assembly and is designed to be substantially the same size as a central opening 106 of the duck billed valve assembly 98. The stopper 104 is inserted into the central opening 106 in the duck bill valve assembly 98 and seals the intake opening 96 of the pump 46 closed when the pump 46 is not in use. Further, as the bathing suit top 10 will be worn at the beach and in the water, the stopper 104 prevents water or sand from entering the pump 46. The duck bill valve assembly 98 is designed to be of substantially the same outer diameter as the inner diameter of the intake opening 96 of the pump 46 such that when the duck bill valve assembly 98 is installed, there is no air leakage around the assembly 98. The duck bill valve 100 consists of a small hollow plastic tube 110 which is pressed flat at one end 112 and open at the other end 114. The duck bill valve 100 is designed such that in its relaxed position, the flattened end 112 of the tube 110 remains slightly open, but the back air pressure from the pump 46 prevents air from leaking out of the pump 46. When the pump 46 is depressed, the further increase in back pressure keeps the air from leaking through opening in the flattened end 112 in the duck billed valve. When the pump 46 is released, there is no back air pressure in the pump 46, as all of the air has been forced into the breast support air bladders 42. The flattened end 112 of the duck bill valve 100 will open slightly and enable air to be drawn in through the intake opening 96 of the pump 46. Once the pump 46 has returned to its relaxed position, the back air pressure that has built up in the pump 46 will once again keep the air from leaking out. If the wearer has inflated the breast support air bladders 42 too much, the open end 114 of the duck bill valve 100 is pressed in a direction that is orthogonal to the plane of the flattened end 112 of the duck bill valve 100. The orthogonal pressure on the flattened end 112 of the valve will force the flattened end 112 to open up and enable air to be released from the breast support air bladders 42 out through the intake opening 96 of the pump 46.

Also illustrated in the cut away view of FIG. 5 is the second or outlet valve 80 of the pump 46 allowing air to flow from the pump 46 into the central air chamber 78. The outlet valve 80 is desirably a small T-shaped incision that is cut in a top layer 116 of the central air channel 78 of the integrated inflatable assembly 44. The incision is provided such that when the pump 46 is depressed, air will be forced out of the pump 46 through the incision and into the central air channel 78. Preferably, the longer of the stem 118 and cross bar 120 of the T-shaped incision is no greater than 0.6 inches, and, preferably no greater than 0.4 inches. Desirably, the width of the central air channel 78 is no greater than one time the length of the stem 118 of the incision. Specifically, it has been found that if the width of the central air chamber is greater, the pump 46, as it returns to its relaxed position, will draw a significant amount of air from the central air chamber, rather than primarily through the outlet valve 80, thereby significantly lowering the efficiency of the pump 46.

The assembly procedure of the integrated inflatable assembly 44 is as follows. First the duck bill valve assembly 98 is heat sealed into the intake opening 96 of the pump 46. The open end of the pump 46 is positioned over the outlet valve 80 such that the outlet valve 80 is located in the center of the pump 46. The mounting extension 94 of the pump 46 is then heat sealed to the top layer 116 of the inflatable assembly 44.

Figure 7:
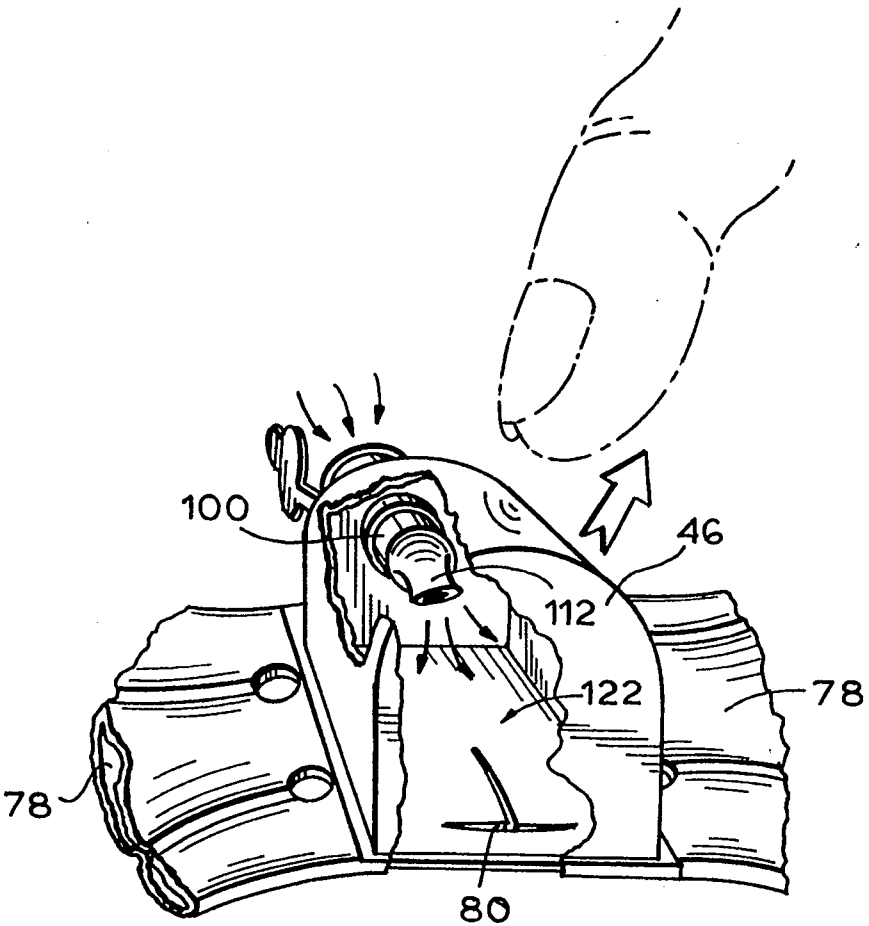
FIG. 7 is a perspective view of the rear of the pump of the swimsuit of FIG. 1 as it expands when it is released, illustrating the airflow.
Figure 6:
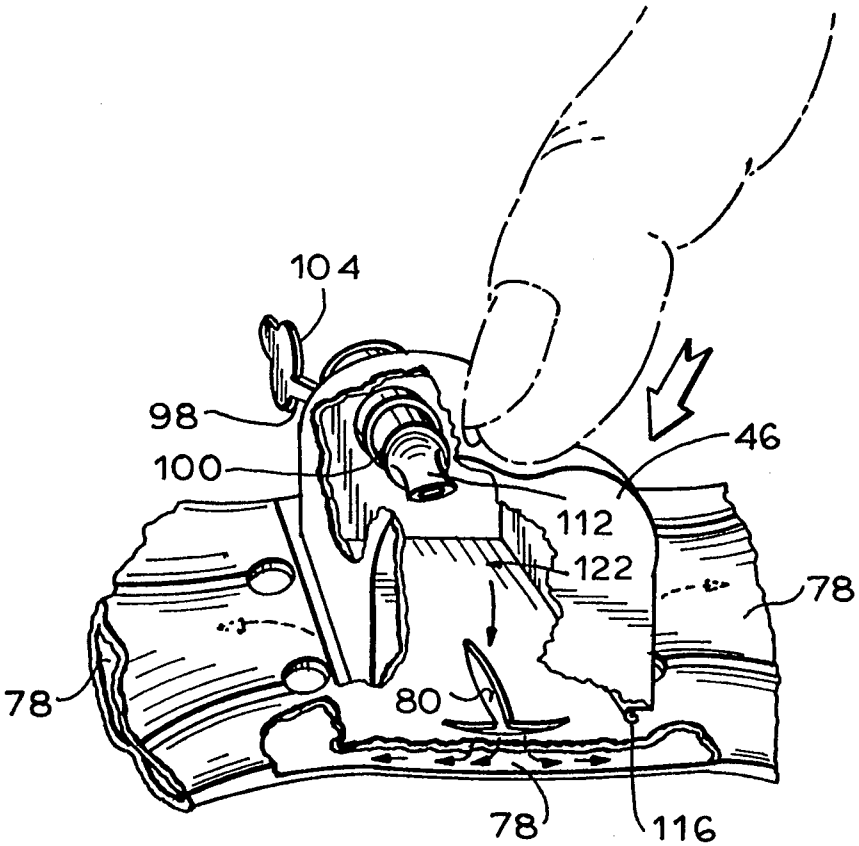
FIG. 6 is a perspective view of the pump of the swimsuit of FIG. 1 as it is compressed by the user, illustrating the airflow.

FIGS. 6 and 7 illustrate the operation of the pump 46 in communication with the central air chamber 78. To pump air into the breast support bladder 42 (not shown), the stopper 104 on the duck bill valve assembly 98 is open such that air is free to flow into a pumping chamber 122 of the pump 46. As illustrated in FIG. 6, when the pump 46 is depressed, the flattened end 112 of the duck bill valve 100 is closed and air is forced from the pump 46 through the T-shaped outlet valve 80 in the top layer 116 of the central air channel 78 for distribution into the individual breast support air bladders 42. As illustrated in FIG. 7, when the pump 46 is released, the elastomeric material will cause the pump 46 to spring back to its relaxed position. The flattened end 112 of the duck bill valve 100 will open up, and air will be drawn through the duck bill valve 100 into the pumping chamber 122 as it expands. Without the air pressure forcing the T-shaped outlet valve 80 open, the resiliency of the material forming the second outlet valve 80 will cause the valve 80 to close itself off and air from the central air channel 78 is prevented from leaking back into the pump 46. Air is therefore free to flow from one breast support bladder 42 through the central air chamber 78 and into the other breast support air bladder 42 to equalize the air pressure in both chambers.

Referring back to FIG. 1, the bathing suit top 10 of the present invention is assembled as follows. The first and second inner fabric layers 48,50 of each cup portion 12,14 are basted together. Next, the first and second inner fabric layers 48,50 and outer fabric layer 52 of each cup portion 12, 14 are sewn together inside out, i.e. with the decorative side of the outer fabric layer 52 facing the first inner fabric layer 48, along the top edge 26 of the cup portion 12,14. As the top edge 26 of the first and second inner fabric layers 48,50 and outer fabric layer 52 are sewn together one piece of the second two-piece support portion 40 is incorporated into the top edge 26 of each cup portion 12,14. A ⅛ inch top stitch is used on the first and second inner fabric layers 48,50 to further secure them together. The cup portions 12,14 are then turned right side in, i.e. the decorative side of the outer fabric layer 52 faces outside and the non-decorative side of the outer fabric layer 52 faces the first inner fabric layer 48. The outer fabric layer 52 is shirred or seamed along the inner side of the cup portions 12,14 to gather the outer fabric layer 52 together along the inner edge 20 of the cup portions 12,14. The outer fabric layer 52 and first and second inner fabric layers 48,50 are basted together along the bottom edge 24 of each cup portion 12,14. The connecting portion 16 is then attached to the outer fabric layer 52, by sewing each connecting edge 58,60 of the connecting portion 16 to the outer fabric layer 52 along the inner edge 20 of each cup portion 12,14. The integrated inflatable assembly 44 is introduced into the bathing suit top 10 of the present invention, by inserting each of the breast support air bladders 42 in between the first and second inner fabric layers 48,50 of each cup portions 12,14 through the unsewn inner edges 20 of the cup portions 12,14. The pump 46 is centered in the connecting portion 16 and the attachment flange 89 is aligned with the basted bottom edge 24 of each cup portion 12,14. The integrated inflatable assembly 44 is sewn to the first and second inner fabric layers 48,50 and outer fabric layer 52 of each cup portion 12,14 along each attachment flange 89 to hold the breast support air bladders 42 firmly in place. The first and second inner fabric layers 48,50, and outer fabric layer 52 are basted together along the inner edge 20, outer edge 22, bottom edge 24, and top edge 26 of each cup portion 12,14 to insure that all elements of the connecting portion 16 and the cup portions 12,14 are sewn together, except for a small opening in the inner edge 20 of the cup portions 12,14 which allows the central air chamber 78 to exit each cup portion 12,14. Each of the pieces of the first two-piece support 18, such as a support band, are sewn to the cup portions 12,14 along the outer edge 22 of the cup portions 12,14. A binding 124 is formed from a thin strip of material, preferably of the same type and design as the outer fabric layer 52, and is sewn to cover the outer edge 22, bottom edge 24 and inner edge 20 of each cup portion 12,14 leaving its beginning and ending open. If desired, an arcuate underwire support 28 is inserted into a small space between the binding 124 and the edges of the cup portion. The binding 124 is then sewn closed at its beginning and end to give the bathing suit top 10 a more finished look. The fabric covering 62, which is preferably formed of the same type material as the outer fabric layer 52, is wrapped over the connecting portion 16 of the bathing suit top to form a ring which is sewn together to complete the assembly of the bathing suit top 10.

Figure 2:
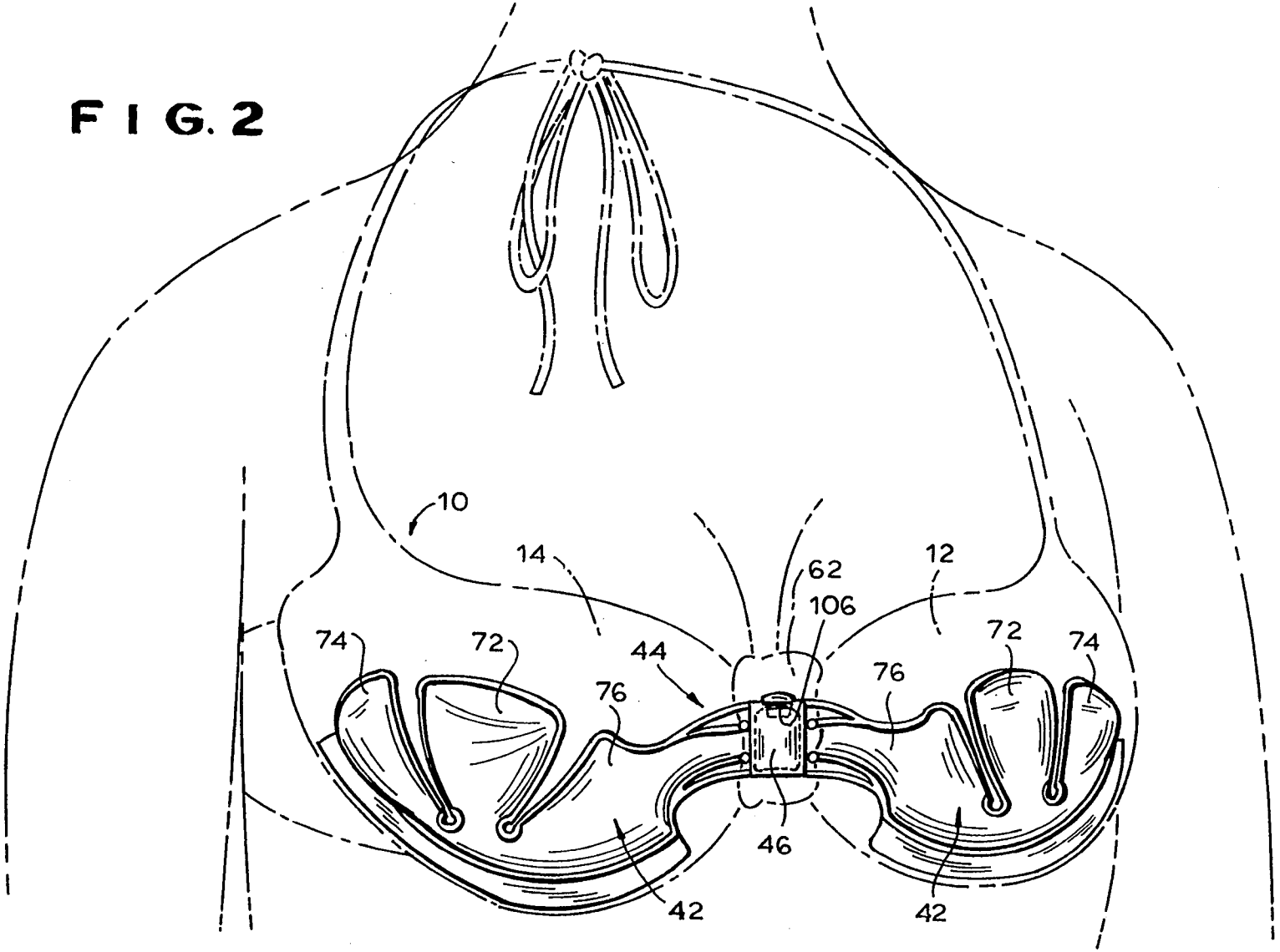
FIG. 2 is a perspective view of the swimsuit of FIG. 1, as worn in an inflated state.

The advantageous operation of the inflatable swimsuit will now be discussed. When the inflatable swim suit top 10 of the preferred invention is deflated, the peninsula shaped segments 66 of the individual breast support air bladders 42 lie substantially proximate to each other. Upon inflation, air is forced into each of the three segments 66 and the three segments 66 fan out to conform to the shape of the woman's bustline. As illustrated in FIG. 2, when the breast support air bladder 42 is inflated, the central segment 72 of the breast support air bladder 42 projects slightly forward and supports the underside of the wearer's breast, while the first and second side segments 74,76 fan out and support the sides of the wearer's breast. The three segment design is better able to accommodate different levels of support for different breast sizes by automatically fanning out to different degrees depending on the size of the breast being supported and the amount of air that is forced into the bladders 42. Further, the preferred three-segmented breast support air bladder 42 is designed to conform to the shape of the breast, without causing unnatural bulging of the bathing suit top 10 which would indicate that such supporting members are being used. This configuration is advantageous in cases where the wearer does not want to inflate the breast support air bladders 42 to their full capacity, since, with each pump, both sides of the swimsuit will be increased at identically the same rate. If each cup portion 12, 14 of the bathing suit is individually inflated, in most cases the two breast support air bladders 42 will be unevenly inflated and will require an adjustment to be made to one or both bladders 42 to try to equalize the inflation level of both bladders 42. Thus the equal and simultaneous inflation of both cup portions 12,14 of the bathing suit top 10 provides for a more uniform appearance for the wearer.

A typical bikini bathing suit top provides little coverage to hide a pump 46, therefore the pump 46 of the present invention is designed to be small enough to fit in between the two cup portions 12,14 and is further hidden by the ring shaped fabric covering 62. Further, by using a single pump 46 to fill both breast support air bladders 42 rather than using one pump per bladder 42, a significant amount of space can be saved on the bathing suit top 10. Further, the single pump design, provides for a more discreet pump size and location. By locating the pump 46 in the center of the top 10, the user can easily access the pump 46 and operate it discreetly using one hand while the top 10 is being worn. The single pump design adds an additional cost savings as to pumps do not have to be manufactured and installed onto the bathing suit top 10.

Further, the integrated inflatable assembly 44 of the present invention is an advantageous design, as the air pump 46 is always with the bathing suit and therefore can not be forgotten or lost. If during wear, air accidently leaks out of the bathing suit top 10, the pump 46 is integrated into the suit and the bathing suit can be discreetly inflated in a public place, such as the beach. Advantageously, the pump 46, duck bill value and T-shaped outlet valve 80 are configured to enable the user to manually inflate the suit by simply blowing air into the central opening 106 of the duck bill valve 100. In addition, the pump 46 and integrated inflatable assembly 44 are designed to be inexpensive to produce, and to be reliable. The simple and elegant integrated design of the pump 46 requires no moving parts which would increase the chances of a malfunction and therefore decrease the overall reliability of the pump 46. Further, the pump 46 uses no metal pieces which would be uncomfortable against the skin of the wearer. Also, metal pieces will rust when they are exposed to water, and would introduce an additional failure mode to the pump 46. Therefore, the simple and elegant integrated design of the pump 46 of the present invention is advantageous as it is highly reliable and easy to produce.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

We claim:

1. A bathing suit, comprising:

a top portion, comprising:

a left side cup portion for receiving the left breast of said wearer;

a right side cup portion for receiving the right breast of said wearer; and a center portion connecting said right side cup portion and said left side cup portion;

a bladder assembly contained within said top portion, said bladder assembly defining a continuous inflatable channel extending into said right side cup portion and into said left side cup portion, comprising:

an inflatable left side bladder section having spreadable portions, said inflatable left side section being contained in said left side cup portion, said spreadable portions of said left side section fanning outward upon inflation of said assembly for lifting and shaping the left breast of said wearer;

an inflatable right side bladder section having spreadable portions, said inflatable right side section being contained in said right side cup portion, said spreadable portions of said right side section fanning outward upon inflation of said assembly for lifting and shaping the right breast of said wearer;

a center bladder section connecting said inflatable left side section and said inflatable right side section;

said spreadable portions comprising peninsular-shaped members separated by slits; and a pump secured to said assembly, said pump communicating with said channel to adjustably inflate and deflate said assembly.

2. The bathing suit of claim 1, wherein said pump forms a single unit with said bladder.

3. The bathing suit of claim 2, wherein said bladder sections are integrally formed.

* * * * *